US009800970B2

(12) United States Patent
Proni

(10) Patent No.: US 9,800,970 B2
(45) Date of Patent: Oct. 24, 2017

(54) LOUDSPEAKER SYSTEM WITH PASSIVE RADIATOR

(71) Applicant: Lucio Proni, Weston, FL (US)

(72) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 67 days.

(21) Appl. No.: 14/950,662

(22) Filed: Nov. 24, 2015

(65) Prior Publication Data

US 2017/0150249 A1 May 25, 2017

(51) Int. Cl.

| | |
|---|---|
| ***H04R 1/00*** | (2006.01) |
| ***H04R 1/28*** | (2006.01) |
| ***H04R 9/06*** | (2006.01) |

(52) U.S. Cl.

CPC ..... *H04R 1/2834* (2013.01); *H04R 9/063* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,327,504 | A * | 7/1994 | Hobelsberger | H04R 1/227 381/350 |
| 5,432,860 | A | 7/1995 | Kasajima et al. | |
| 6,714,656 | B1 | 3/2004 | Coffin | |
| 7,158,648 | B2 | 1/2007 | Butters et al. | |
| 7,551,749 | B2 * | 6/2009 | Rosen | B60R 11/0217 381/186 |
| 2014/0029782 | A1 | 1/2014 | Rayner | |

* cited by examiner

*Primary Examiner* — Amir Etesam
(74) *Attorney, Agent, or Firm* — GrayRobinson, P.A.; Thomas L. Kautz

(57) ABSTRACT

A loudspeaker system is provided in which a passive radiator and a driver are connected to one another within a speaker enclosure by an acoustic coupler having a coupler opening such that the driver and the passive radiator are located in different planes.

30 Claims, 8 Drawing Sheets

LOUDSPEAKER SYSTEM WITH PASSIVE RADIATOR

FIELD OF THE INVENTION

This invention relates to loudspeakers, and, more particularly, to a loudspeaker system including an acoustic coupler connected between a driver and a passive radiator wherein a coupler opening area of the acoustic coupler is less than or equal to the mounting area of the driver.

BACKGROUND OF THE INVENTION

Loudspeaker systems generally include an enclosure having an interior within which a driver is mounted in alignment with an opening formed in the front panel of an enclosure. In order to reinforce the low frequency output of the loudspeaker system, it is common to employ a port or a passive radiator in the speaker enclosure. Ports and passive radiators resonate at low frequencies, typically lower than that of the driver/enclosure system, and therefore enhance reproduction of low frequencies produced by the driver. In most cases, a ported or passive radiator speaker system has a wider low frequency bandwidth than a sealed-enclosure design.

A port is essentially a tube having a length dimension, or distance between its opposite ends, wherein one end is typically located at the front panel of the enclosure and the opposite end is positioned within the interior of the speaker enclosure. To maintain system linearity at very low frequencies, the cross sectional area of the port must be large. Further, a large cross sectional area is required when using ports to avoid "chuffing" or air flow noises. Ports with a large cross sectional area must be longer than small area ports in order to be tuned to the same low frequency. In applications where the speaker enclosure must be relatively small, such as subwoofer speaker systems designed for use in vehicles, it is not possible to use long, low-frequency ports due to space considerations. The speaker enclosure must house both the driver and the port, which requires a relatively large volume box. If the ports are designed with a smaller cross sectional area in an attempt to overcome the space issue, unacceptable air flow noises would result. On the other hand, tuning a port for higher frequencies, which allows it to be shortened and take up less space, sacrifices the desired system frequency response.

Passive radiators solve some of the issues with ports noted above because their length dimension may be much less than that of tubes and they may take up less volume in the interior of the speaker enclosure. One typical form of passive radiator resembles a driver, i.e. it includes upper and lower suspensions and a diaphragm, but the motor structure of the driver is eliminated. When mounted in a speaker enclosure, internal air pressure generated by axial movement of the driver creates air pressure waves that cause the passive radiator to move. Like ports, passive radiators resonate at a frequency lower than that of the driver/enclosure system. System linearity at very low frequencies is obtained with a passive radiator by making its radiating area, e.g. the surface of the diaphragm in the example given above, relatively large compared to that of the driver itself. While the length dimension of passive radiators may be made more compact than ports, the large radiating area requirement creates the need for a larger surface area at the baffle of the enclosure or the use of multiple enclosure faces. Such surface area may amount to the equivalent of two drivers or more since the radiating area of the passive radiator is larger than that of the diaphragm of the driver. Consequently, the overall dimension of the speaker enclosure needed when using a passive radiator may be greater than the area which is available in a given application. This is particularly true in the case of loudspeaker systems for use in vehicles wherein only one wall of the enclosure may be exposed for use as a radiating surface and/or if the total radiating area is small due to space constraints.

SUMMARY OF THE INVENTION

This invention is directed to a loudspeaker system in which a passive radiator and a driver are connected to one another within a speaker enclosure by an acoustic coupler such that the driver and passive radiator are located in different planes. Further, the acoustic coupler is formed with a coupler opening area which is less than or equal to the mounting area of the driver.

In the presently preferred embodiment, the driver of the loudspeaker system comprises a frame, a motor structure, an upper suspension, a lower suspension and a diaphragm extending between the motor structure and upper suspension. The speaker enclosure is formed with a number of interconnected panels defining an interior which is closed except for an opening in the front panel of the enclosure. In one aspect of this invention, the passive radiator and driver are mounted relative to one another in such a way as to reduce the overall dimensions of the speaker enclosure. Preferably, the passive radiator is connected to the front panel of the speaker enclosure at its opening. The mounting structure of the driver, discussed below, is located within the enclosure interior in a plane that is spaced from the front panel and the passive radiator. The driver and passive radiator are preferably concentric to one another, but may be linearly offset and/or angularly offset, as described below.

In another aspect of this invention, the acoustic coupler preferably includes a wall having a generally annular portion defining a coupler opening area. The mounting structure of the driver has a mounting diameter defining a mounting area as described below. Preferably, the coupler opening area of the acoustic coupler is less than or equal to the mounting area of the driver. In fact, the ratio between the mounting area and coupler opening area may be three-to-one or higher, e.g. the mounting area can be three times as large as the coupler opening area, or more, without sacrificing the performance of the loudspeaker system or producing objectionable air noises.

In operation, excursion of the motor structure of the driver generates air pressure waves within the interior of the enclosure which impact the passive radiator causing it to resonant at a frequency lower than that of the driver/enclosure system. The sound output from the driver is transmitted through the annular portion of the wall of the acoustic coupler where it is accelerated without creating unwanted air noise. Because the driver and passive radiator are located in different planes when mounted to the speaker enclosure, a substantial amount of baffle or panel space is saved compared to prior art systems in which the passive radiator and driver are mounted side-by-side. This is an important advantage in applications such as loudspeaker systems for vehicles wherein space is limited and only one surface of the enclosure may be available for radiation of the sound output from the driver.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
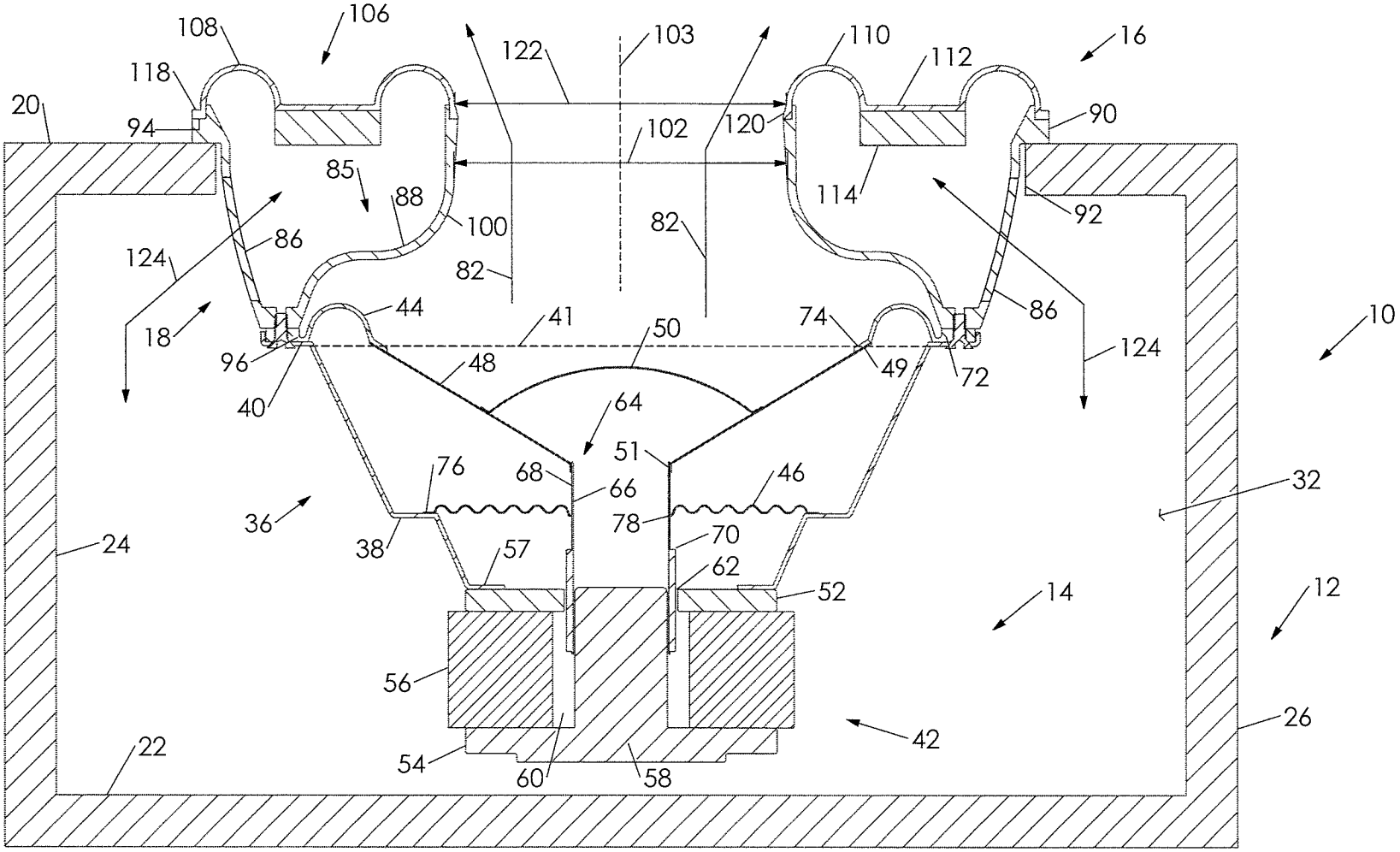
FIG. 1 is a cross sectional view of the loudspeaker system of this invention.
Figure 2:
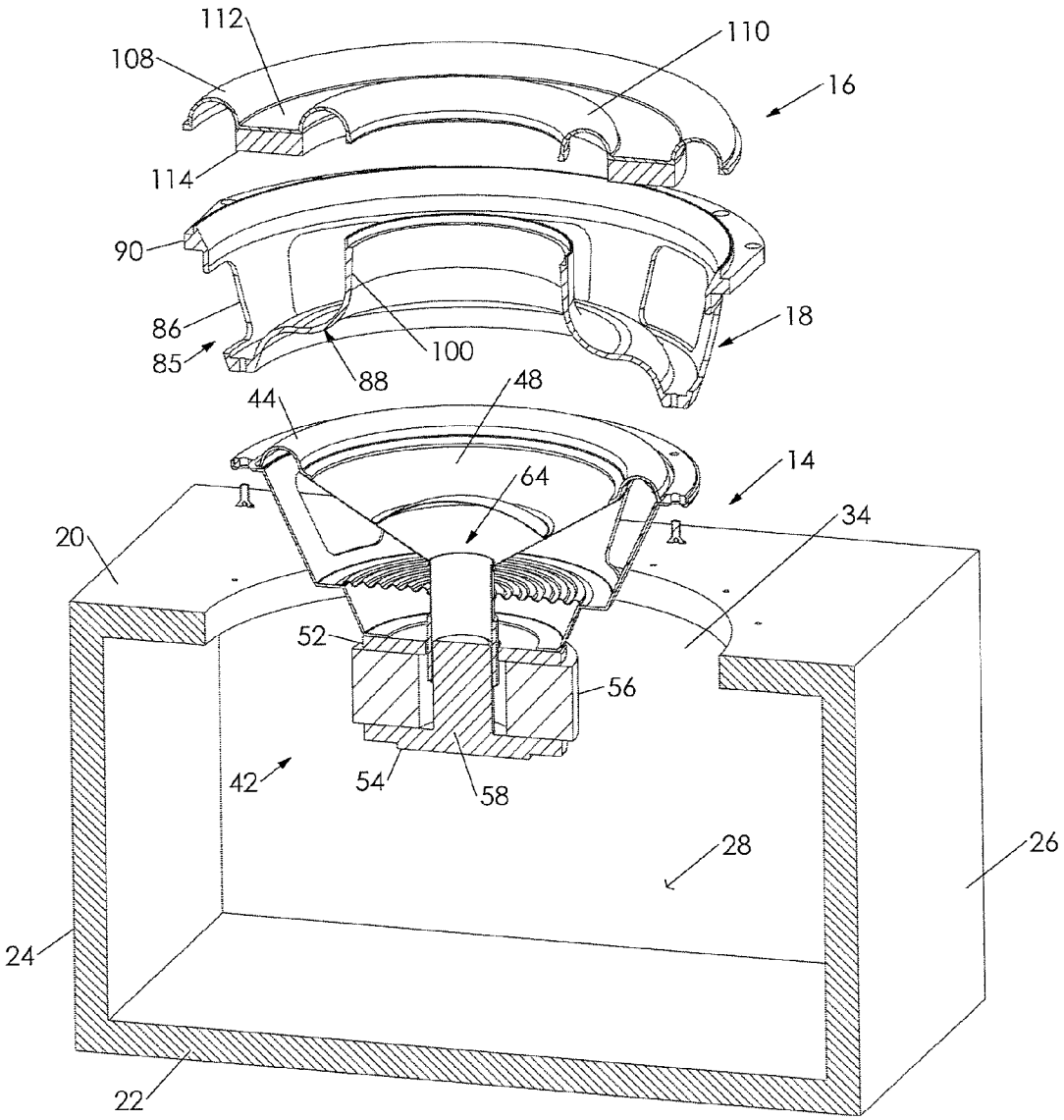
FIG. 2 is an exploded perspective view, in partial cross section, of the loudspeaker system depicted in FIG. 1.
Figure 3:
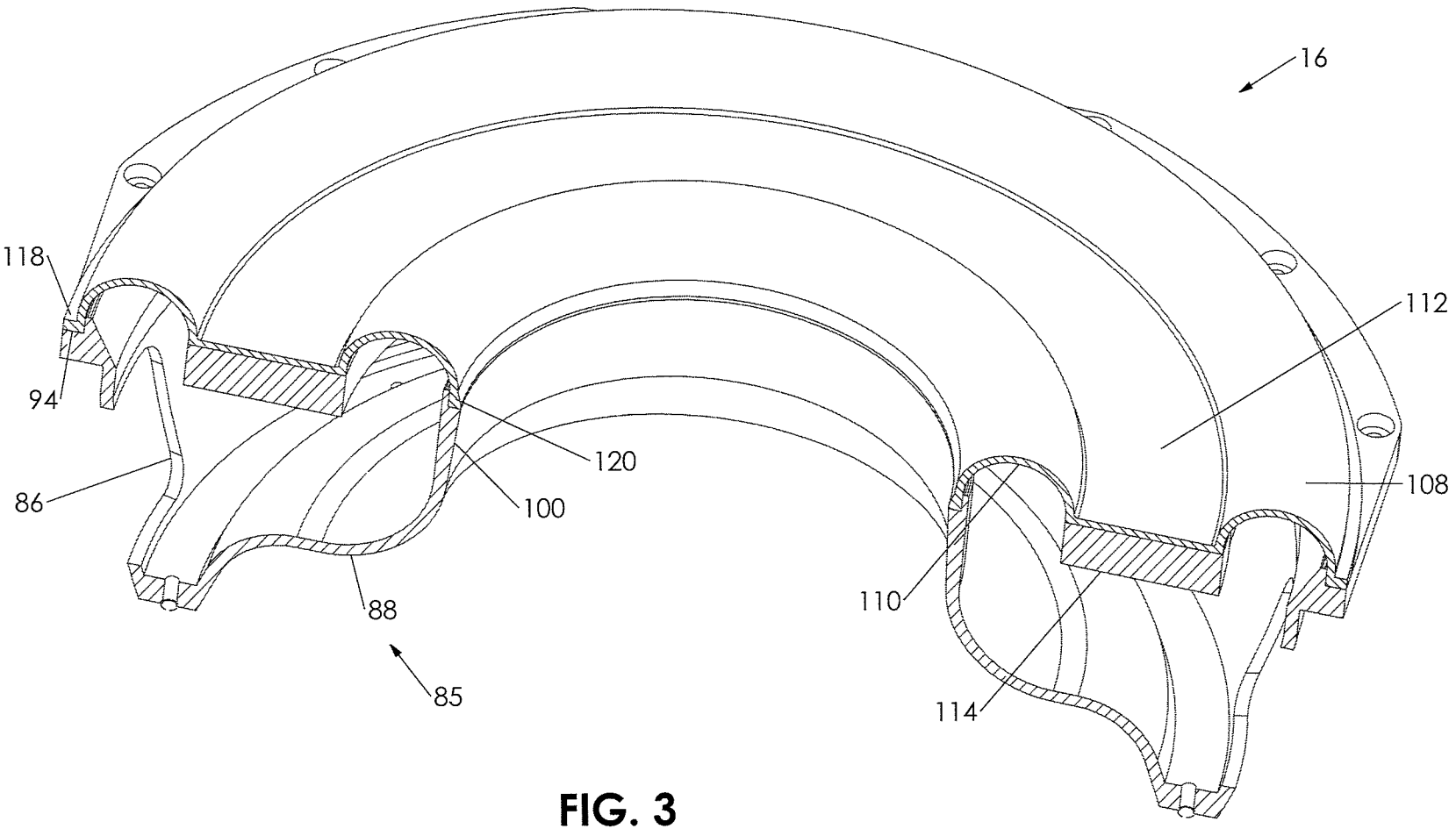
FIG. 3 is a perspective view of a portion of FIG. 2 showing the passive radiator and acoustic coupler connected to one another as an integrated unit.

Referring initially to FIGS. 1-3, one embodiment of a loudspeaker system 10 is illustrated which comprises a speaker enclosure 12, a driver 14, a passive radiator 16 and an acoustic coupler 18. For purposes of the present discussion, the terms "upwardly," "downwardly," "upper," "lower," "top," "bottom," "vertical" and horizontal" refer to vertical relationships of the elements of system 10 in the orientation that is depicted in the drawings, and the terms "inner," "outer," "inwardly" and "outwardly" refer to radial relationships of the system 10 elements in the orientation illustrated in the Figs.

The loudspeaker enclosure 12 includes a front panel 20, a back panel 22, opposed side panels 24, 26, and, opposed end panels 28, one of which is shown in FIG. 2. The panels 20-28 are interconnected to form a hollow interior 32. The interior 32 is closed except for a panel opening 34 formed in the front panel 20. While the opening 34 is depicted as circular in FIG. 2, it should be understood that such opening 34 could be oval, square or essentially any other shape.

The driver 14 comprises a frame 36 having a lower seat 38 and an upper flange 40, a motor structure 42, an upper suspension 44, a lower suspension 46, a diaphragm 48 and a dust cap 50. The motor structure 42 includes a top plate 52 and a back plate 54 which are spaced from one another and mount a permanent magnet 56 between them. A lower end 57 of the frame 36 is mounted to the top plate 52 by adhesive, fasteners or other suitable means. A pole piece 58 is integrally formed with and extends upwardly from the back plate 54 into a central bore 60 formed in both the magnet 56 and the top plate 52. A magnetic gap 62 is formed between the top plate 52 and the pole piece 58. A voice coil 64 is located in the magnetic gap 62. It comprises a hollow, cylindrical-shaped former 66 having an outer surface 68 which mounts a wire winding 70. The former 66 is concentrically disposed about the pole piece 58 such that the voice coil 64 is axially movable within the magnetic gap 62 during operation of the driver 14.

The voice coil 64 is held in place relative to the pole piece 58 by the upper suspension 44, lower suspension 46 and diaphragm 48. An outer edge 72 of the upper suspension 44 is connected to the flange 40 of the frame 36, and its inner edge 74 is connected to the upper end 49 of the diaphragm 48. The lower end 51 of diaphragm 48 mounts to the outer surface 68 of former 66. An outer edge 76 of the lower suspension 46 is connected to the lower seat 38 of frame 36, and its inner edge 78 mounts to the former 66 at a point below where the diaphragm 48 is connected. The dust cap 50 is mounted to the diaphragm 48 in position to overlie the voice coil 64 and pole piece 58 in order to protect such elements from dirt, dust and other contaminants. In response to the input of electrical energy to the wire winding 70, the voice coil 64 is moved axially within the magnetic gap 62. Since the diaphragm 48 is operatively connected to the voice coil 64, it deflects and moves with the excursion of the voice coil 64 producing sound waves that radiate in a direction depicted by the arrows 82 in FIG. 1.

As used herein, the following terms are considered to have the specific meanings given below. The term "mounting structure" refers to the flange 40 of the driver frame 36 which is employed to mount the driver 14 within the interior 32 of the speaker enclosure 12. The flange 40 is depicted in the Figs. as an annular member that extends around the entirety of frame 36. In some loudspeaker system designs, a flange such as flange 40 may be replaced by discrete tabs spaced about speaker frame at intervals from one another. Such arrangement, and similar variations, are nevertheless considered "mounting structure" for purposes of this invention.

The term "mounting diameter" in the embodiments illustrated in the drawings refers to the diameter of the mounting structure of the driver 14, e.g. the flange 40 of frame 32, which is circular in shape. It should be understood, however, that the frames of drivers may be fabricated in shapes other than circular, such as oval, square or other shapes. Consequently, the terms "mounting diameter" generally and "diameter" in particular are expressly not limited to the diameter of a circle but are meant to encompass any other symmetrical and non-symmetrical shapes. As such, "mounting diameter" is considered to comprise the largest transverse dimension of a particular shape. Further, as noted above, the mounting flange of a particular driver such as flange 40 of frame 32 may be replaced by spaced tabs of other mounting structure. The "mounting diameter" of those structures is therefore considered to be the largest transverse dimension between such spaced tabs or the like.

The term "mounting area" refers to the area circumscribed by the mounting structure of a driver of given shape having a particular mounting diameter. For example, in the case of the circular flange 40 of frame 32, the "mounting area" is considered to be the area circumscribed by such circular flange 40. The mounting area of a square driver, an oval driver or some other shape is considered to be the area circumscribed by those shapes, each having a mounting structure with a mounting diameter.

The driver 14 is mounted within the interior 32 of the enclosure 12 by the acoustic coupler 18 such that the mounting structure or flange 40 of the driver 14 is preferably generally concentric to and vertically spaced from the panel opening 34 in the front panel 20 of enclosure 12. The acoustic coupler 18 is preferably, although not necessarily, formed in a one-piece cast or stamped construction comprising a wall 85 having an outer section 86 joined to an inner section 88. The upper end 90 of the outer section 86 is mounted by fasteners (not shown) to the front wall 20 of enclosure 12 at the peripheral edge 92 of the panel opening 34 in the front panel 20. A seat 94 is formed in the upper end 90 for mounting the passive radiator 16, as described below. The juncture of the outer and inner sections 88, 86 of the wall 85 of acoustic coupler 18 rests atop the flange 40 formed in the frame 36 of driver 14 where it is attached thereto by fasteners 96.

In the presently preferred embodiment, the inner section 88 of the acoustic coupler 18 a mouth or annular portion 100 which forms a coupler opening 102 denoted in FIG. 1 by a horizontal line spanning the annular portion 100. As illustrated in FIG. 1, the annular portion 100 of inner section 88 is substantially vertically oriented and the coupler opening 102 it defines is preferably generally concentrically disposed relative to the panel opening 34 in the front panel 20 of enclosure 12 and relative to the flange 40 of the driver 14. For purposes of the present discussion, the cross sectional area of the coupler opening 102 defined by the annular portion 100 of inner section 88 is referred to herein as the "coupler opening area" of the loudspeaker system 10.

The passive radiator 16 of loudspeaker system 10 comprises a double surround 106 having an outer roll 108 and an inner roll 110 joined together by a ring 112. The ring 112, outer roll 108 and inner roll 110 may be circular, square, rectangular, oval or essentially any other shape. A tuning block 114 may be mounted along an inner surface 116 of the ring 112, or, alternatively, directly to one or both of the outer roll 108 and inner roll 110. The tuning block 114 may be formed of plastic, wood or other material whose mass may be varied to tune the frequency at which the passive radiator 16 resonates, as is well known in the art. An outer edge 118 of the outer roll 108 is preferably affixed to the seat 94 formed in the outer section 86 of acoustic coupler 18, and an inner edge 120 of the inner roll 110 is connected at the top of the annular portion 100 of the inner section 88 of acoustic coupler 18. The mouth 122 of the passive radiator 16, foiled by the inner roll 110 and depicted by a horizontal line in FIG. 1, is preferably generally concentrically disposed relative to the panel opening 34 in the enclosure 12, to the coupler opening 102 of the acoustic coupler 18 and to the flange 40 of the driver 14.

With respect to the phrase "generally concentric" used above, it is contemplated that the loudspeaker system 10 will function as intended in the event of some lateral and/or angular offset between the driver 14, passive radiator 16 and acoustic coupler. As viewed in FIG. 1, the term "lateral" refers to a side-to-side direction between the side panels 24, 26, or an end-to-end direction between the end panels 28. The term "angular" refers to an angle measured relative to a vertical axis 103 passing through the center of the passive radiator 16. In a preferred embodiment of this invention, the driver 14, passive radiator 16 and acoustic coupler 18 are concentric to one another, e.g. the central axis of each is substantially coincident with axis 103. The central axis of acoustic coupler 18 is coincident with an axis passing through the center of its annular portion 100, and the central axis of the driver 14 passes through the center of pole piece 58. The term "generally concentric" is intended to describe the positional relationship between the driver 14, passive radiator 16 and acoustic coupler 18 in which such components are not exactly concentric. In particular, the central axes of the driver 14 and passive radiator 16 may be laterally offset from one another by an amount within up to one mounting diameter of the driver 14, and angularly offset by 10° or more, and still be considered "generally concentric" for purposes of this invention.

One aspect of this invention is predicated on the concept of orienting the passive radiator 16, acoustic coupler 18 and driver 14 relative to one another such that the dimensions of the speaker enclosure 12 may be reduced compared to prior art systems. This is particularly advantageous in applications such as vehicle sound systems, for example, in which space is limited. With reference to FIG. 1, as noted above the driver 14 is mounted by the acoustic coupler 18 in a position vertically below the passive radiator 16. For purposes of the present discussion, the mounting structure or flange 40 of the driver 14 is considered to lie within a plane depicted by the line 41 shown in FIG. 1. The plane 41 is horizontally disposed as illustrated in the drawings but could assume any orientation depending upon how the loudspeaker system 10 is installed in a particular application. The mounting structure or flange 40 of driver 14, and, hence, plane 41, are therefore spaced from the front panel 20 of the speaker enclosure 12 and from the passive radiator 16 connected to the front panel 20. The fact that the driver 14 and passive radiator 16 lie in different planes, rather than side-by-side along the front panel as in many prior art designs, significantly reduces the space requirements of the loudspeaker system 10 and therefore allows the speaker enclosure 12 to be smaller in order to accommodate applications where space is limited.

In the operation of the loudspeaker system 10, axial excursion of the voice coil 64 causes the diaphragm 48 to produce sound output which is directed toward the panel opening 34 in the enclosure 12. See arrows 82. In the course of movement with the voice coil 64, the diaphragm 48 also produces air pressure waves, represented by the arrows 124 in FIG. 1, which, in turn, causes the passive radiator 16 to move. As discussed above, the passive radiator 16 resonates at a lower frequency than the driver 14 and enclosure 12 system, and is effective to enhance the reproduction of low frequencies produced by the driver 14.

Another aspect of this invention which allows the size of the speaker enclosure 12 to be reduced involves forming the coupler opening area of the acoustic coupler 18 equal to or smaller than the mounting area of the driver 14. In fact, the mounting area may be three times the size of the coupler opening area, or more, without sacrificing the performance of the loudspeaker system 10 or creating undesirable air noise as the sound output of the driver 14 passes through the coupler opening 102 of the acoustic coupler 18. The relatively smaller size of the coupler opening area allows the size of the panel opening 34 in the front panel 20 of enclosure 12 to be correspondingly reduced. As noted above, in applications such as vehicle sound systems in which space is limited, reduction in the overall size of the speaker enclosure 12 and its front panel 20 is highly advantageous.

Referring now to FIGS. 4-7, an alternative embodiment of a loudspeaker system 130 according to this invention is illustrated. The loudspeaker system 130 employs the same speaker enclosure 12, driver 14 and passive radiator 16 described above in connection with a discussion of the system 10 shown in FIGS. 1-3, and therefore the same reference numbers are used in FIGS. 4-7 to denote like structure in such Figs. Further, the terms "mounting area," "mounting diameter," "mounting structure" and "generally concentric" defined above with reference to FIGS. 1-3 apply equally to the loudspeaker system 130. The primary differences between loudspeaker systems 10 and 130 involve a somewhat different acoustic coupler and how the driver 14 is mounted within the speaker enclosure 12.

Instead of suspending the driver 14 from an acoustic coupler 18 as depicted in FIGS. 1-3, the driver 14 is connected to a support bracket 132 having a lower ring 134 and an upper ring 136. The lower ring 134 of support bracket 132 is mounted by fasteners 96 to the back wall 22 of speaker enclosure 12. The upper ring 136 supports the flange 40 of driver frame 36, the outer edge 72 of upper suspension 44 and the bottom end 138 of the wall 140 of an acoustic coupler 142. The wall 140 has a mouth or annular portion 144 which forms a coupler opening 146 denoted in FIG. 4 by a horizontal line spanning the annular portion 144. The annular portion 144 is substantially vertically oriented and the coupler opening 146 it defines is preferably generally concentrically disposed relative to the panel opening 34 in the front panel 20 of enclosure 12 and relative to the mounting structure or flange 40 of the driver 14. The cross sectional area of the coupler opening 146 defined by its annular portion 144 comprises the "coupler opening area" of the loudspeaker system 130 which is preferably less than or equal to the mounting area of driver 14. The mounting area may be up to about three times greater than the coupler opening area of the acoustic coupler 142.

Figure 5:
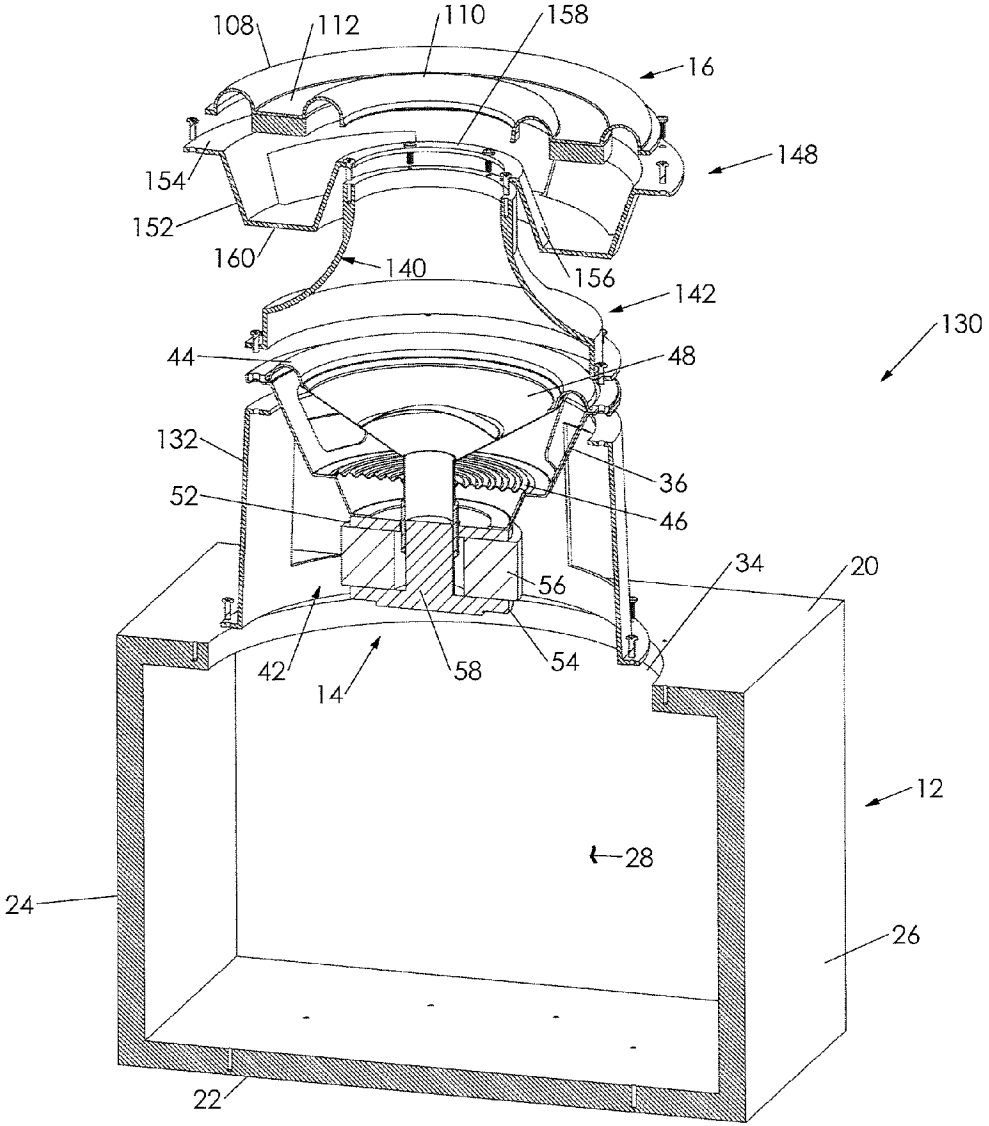
FIG. 5 is an exploded perspective view, in partial cross section, of the loudspeaker system illustrated in FIG. 4.
Figure 6:
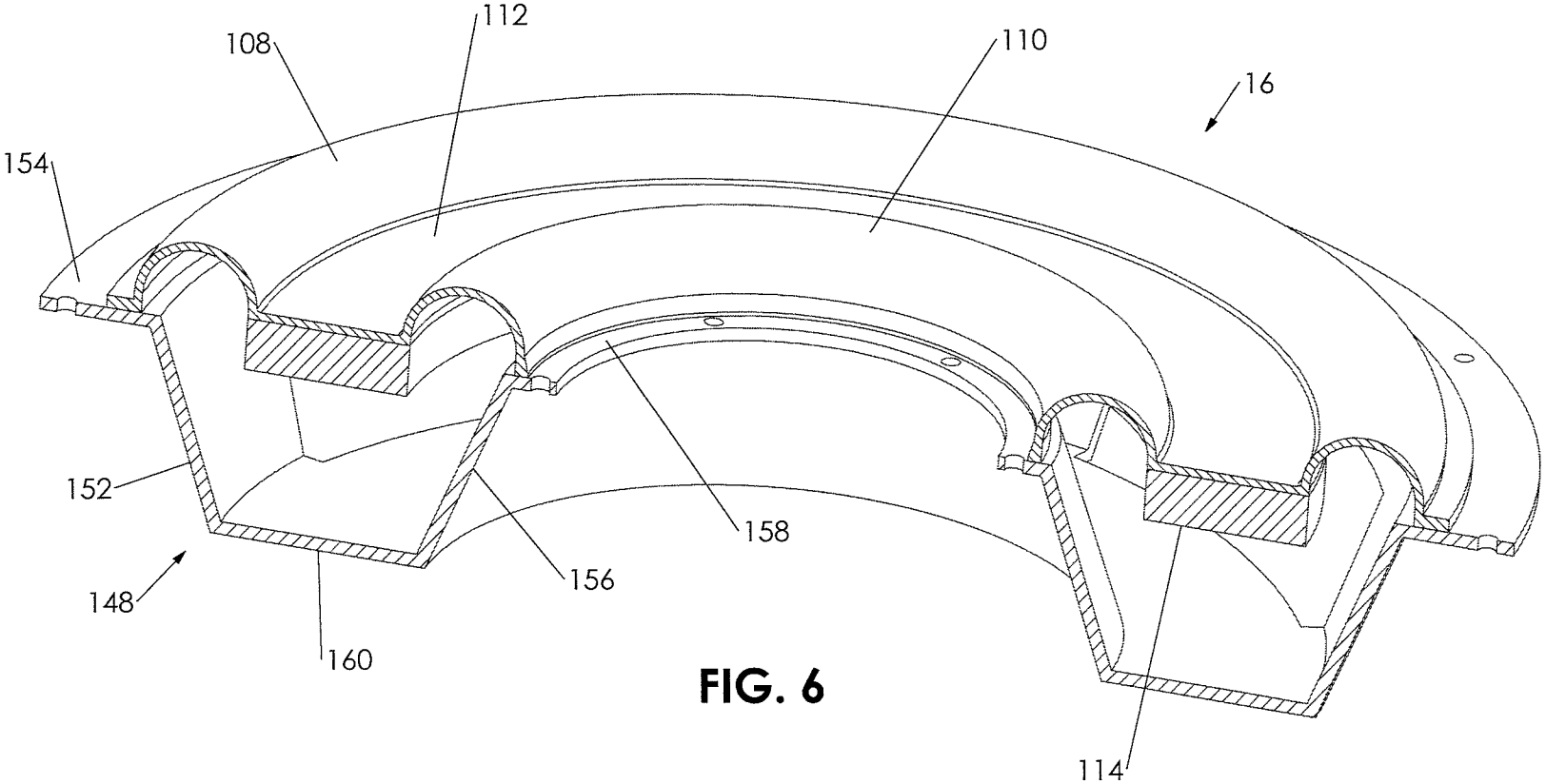
FIG. 6 is a perspective view of a portion of FIG. 5 depicting a passive radiator mounted to an connector frame.

A ring frame 148 is provided to support the passive radiator 16 and the upper end 150 of acoustic coupler 142. As best seen in FIGS. 5 and 6, the ring frame 148 comprises an outer wall 152 with an outer ledge 154, and an inner wall 156 having an inner ledge 158 which are connected by a base plate 160. The outer roll 108 of passive radiator 16 is mounted by adhesive or fasteners to the outer ledge 154 of ring frame 148, and the inner roll 110 is similarly mounted to the inner ledge 158. Fasteners 96 connect the outer ledge 154 to the front panel 20 of speaker enclosure 12, and the upper end 150 of acoustic coupler 142 is mounted by fasteners 96 to the inner ledge 158.

Figure 4:
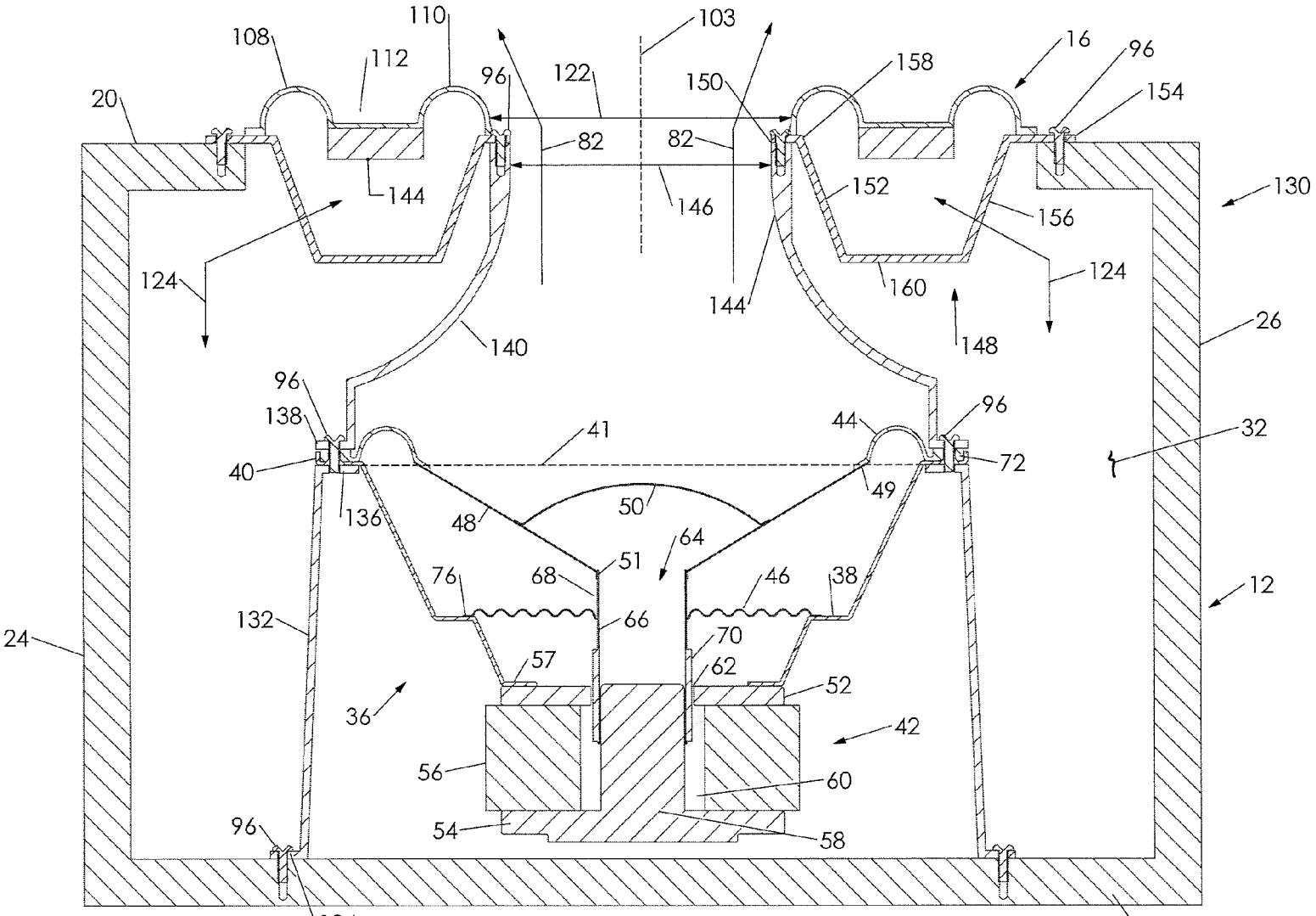
FIG. 4 is a cross sectional view of an alternative embodiment of a loudspeaker system according to this invention.

The driver 14, passive radiator 16 and acoustic coupler 142 of the loudspeaker system 130 illustrated in FIGS. 4-6 are preferably oriented concentric to one another. However, as with the system 10 described in connection with a discussion of FIGS. 1-3, the loudspeaker system 130 of this embodiment will function if such components are "generally concentric" to each other as that term is defined above. Additionally, the mounting structure or flange 40 of driver 14 lies in a plane 41 (horizontally oriented as depicted in the Figs.) which is spaced from the passive radiator 16 and the front panel 20 of speaker enclosure 12 where it is mounted.

Figure 7:
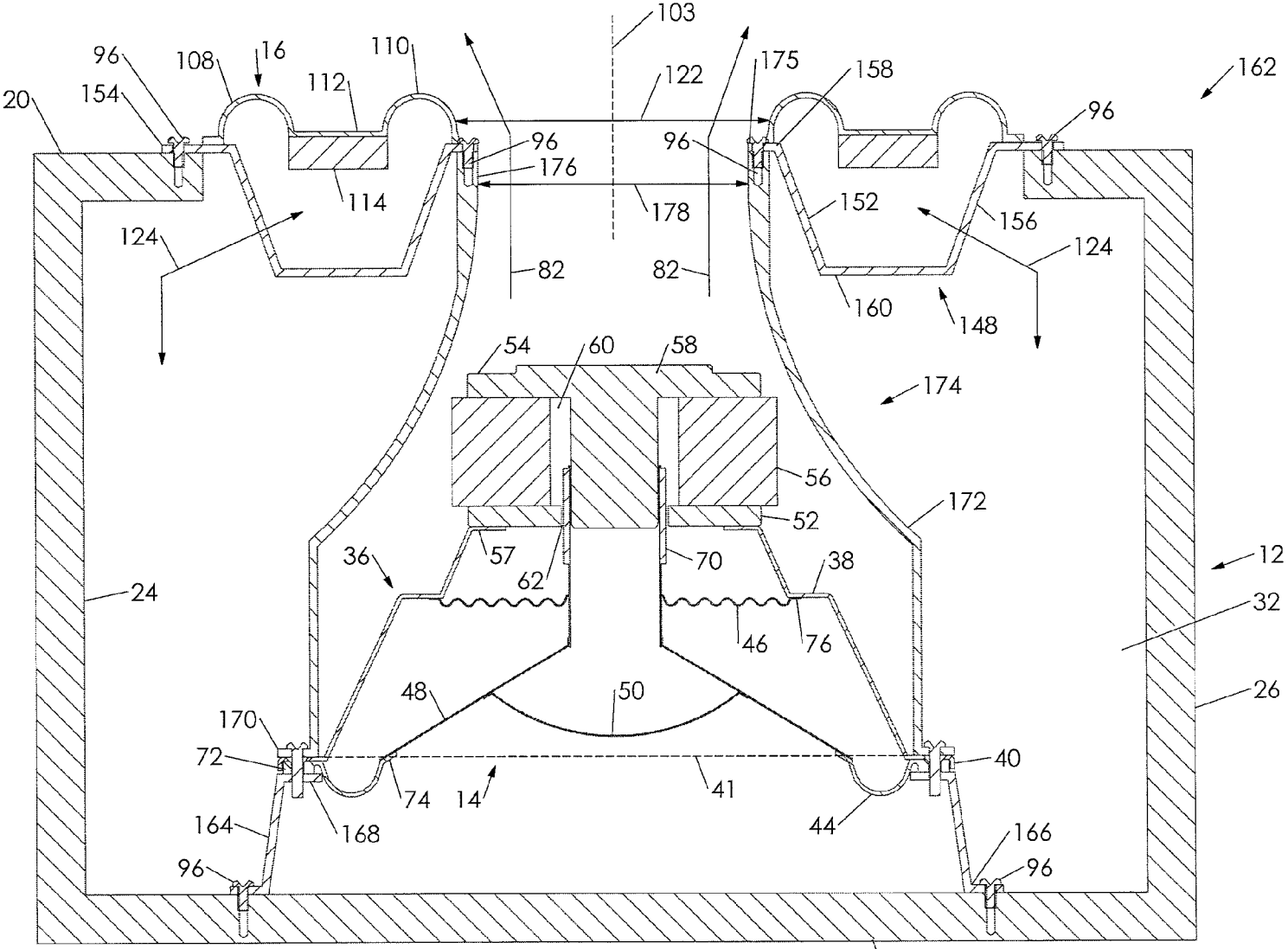
FIG. 7 is a cross sectional view of a still further embodiment of a loudspeaker system according to this invention.
Figure 8:
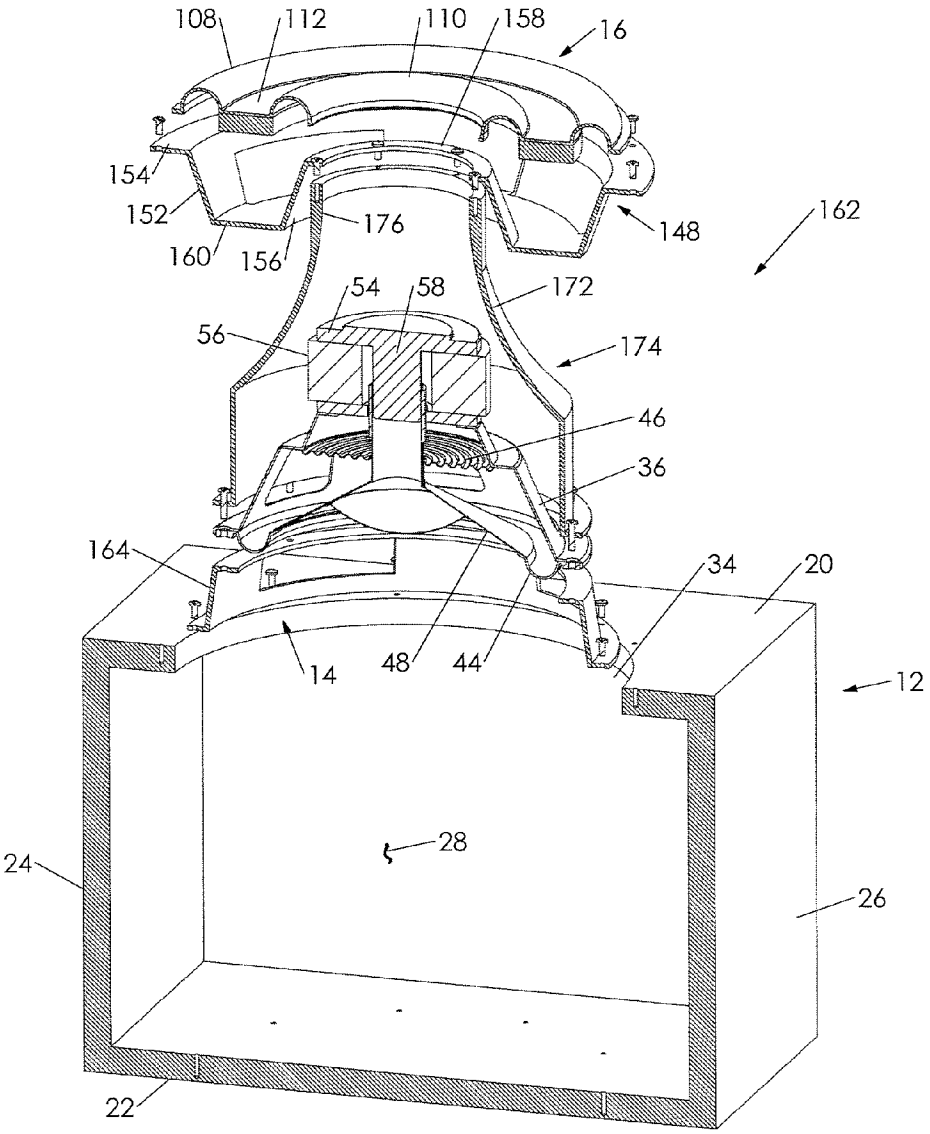
FIG. 8 is an exploded perspective view, in partial cross section, of the loudspeaker system illustrated in FIG. 7.

Referring now to FIGS. 7 and 8, a still further alternative embodiment of a loudspeaker system 162 according to this invention is illustrated. The loudspeaker system 162 employs the same speaker enclosure 12, driver 14, passive radiator 16 and ring frame 148 described above in connection with a discussion of the systems 10 and 130 shown in FIGS. 1-6, and the same reference numbers are used in FIGS. 7 and 8 to denote like structure in such Figs. Further, the terms "mounting area," "mounting diameter," "mounting structure" and "generally concentric" defined above with reference to FIGS. 1-3 apply equally to the loudspeaker system 162. The primary differences between loudspeaker systems 130 and 162 is that the orientation of the driver 14 is reversed, i.e. in the loudspeaker system 130 the sound-radiating surface of the diaphragm 48 of the driver 14 faces the panel opening 34 in front panel 20, whereas in the loudspeaker system 162 the diaphragm 48 faces the back panel 22 of enclosure 12.

The driver 14 is connected to a support bracket 164 having a lower ring 166 and an upper ring 168. The lower ring 166 of support bracket 164 is mounted by fasteners 96 to the back wall 22 of speaker enclosure 12. The upper ring 168 supports the flange 40 of driver frame 36, the outer edge 72 of upper suspension 44 and the bottom end 170 of the wall 172 of an acoustic coupler 174. A top end 175 of the acoustic coupler 174 is connected by fasteners 96 to the inner ledge 158 of ring frame 148. Preferably, the wall 172 has a mouth or annular portion 176 which forms a coupler opening 178 denoted in FIG. 7 by a horizontal line spanning the annular portion 176. The annular portion 176 is substantially vertically oriented and the coupler opening 178 it defines is preferably generally concentrically disposed relative to the panel opening 34 in the front panel 20 of enclosure 12 and relative to the mounting structure or flange 40 of the driver 14. The cross sectional area of the coupler opening 178 defined by its annular portion 176 comprises the "coupler opening area" of the loudspeaker system 162 which is preferably less than or equal to the mounting area of driver 14. The mounting area may be up to about three times greater than the coupler opening area of the acoustic coupler 174.

The driver 14, passive radiator 16 and acoustic coupler 174 of the loudspeaker system 162 illustrated in FIGS. 7 and 8 are preferably oriented concentric to one another. However, as with the system 10 described in connection with a discussion of FIGS. 1-3, the loudspeaker system 162 will function if such components are "generally concentric" to each other as that term is defined above. Additionally, the mounting structure or flange 40 of driver 14 lies in a plane (horizontally oriented as depicted in the Figs.) which is spaced from the passive radiator 16 and the front panel 20 of speaker enclosure 12 where it is mounted.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker system, comprising:

an enclosure having a number of panels interconnected to form an interior, a first panel of said enclosure being formed with a panel opening;

a passive radiator having a central opening and a double suspension comprising an outer roll and an inner roll, said passive radiator being connected to said first panel at said panel opening therein;

a driver having mounting structure which defines a mounting area, said driver being mounted within said interior of said enclosure such that said mounting structure is located in a plane which is spaced from said first panel;

an acoustic coupler connected between said passive radiator and said driver, said acoustic coupler including a wall having a coupler opening which defines a coupler opening area, said coupler opening area being less than or equal to said mounting area.

2. The loudspeaker system of claim 1 in which said double suspension is connected to a tuning block.

3. The loudspeaker system of claim 2 in which said double suspension includes a ring between said inner and outer rolls.

4. The loudspeaker system of claim 3 in which said tuning block is mounted to said ring.

5. The loudspeaker system of claim 3 in which said wall of said acoustic coupler is mounted to said inner roll of said double suspension.

6. The loudspeaker system of claim 1 in which said wall of said acoustic coupler comprises an inner wall joined to an outer wall, said outer wall being connected to said first panel of said enclosure.

7. The loudspeaker system of claim 6 in which said inner wall includes a generally annular portion which forms said coupler opening having a cross sectional area, said cross sectional area of said coupler opening defining said coupler opening area.

8. The loudspeaker system of claim 1 in which said mounting area of said driver is up to about three times greater than said coupler opening area of said acoustic coupler.

9. The loudspeaker of claim 1 in which said driver includes a frame, said mounting structure of said driver comprising at least one flange joined to said frame.

10. The loudspeaker of claim 1 in which said driver is suspended within said hollow interior of said enclosure by said acoustic coupler.

11. The loudspeaker of claim 1 in which said enclosure includes a second panel opposite said first panel, said loudspeaker system further including a support bracket having first and second ends, said first end being connected to said second panel and said second end being connected to said driver and to said acoustic coupler.

12. The loudspeaker of claim 11 in which said driver includes a diaphragm, said driver being mounted to said support bracket so that said diaphragm faces said first panel of said enclosure.

13. The loudspeaker of claim 11 in which said driver includes a diaphragm, said driver being mounted to said support bracket so that said diaphragm faces said second panel of said enclosure.

14. The loudspeaker of claim 11 further including a ring frame mounted to said first panel of said enclosure at said panel opening therein, said passive radiator being connected to said ring frame.

15. The loudspeaker of claim 14 in which said acoustic coupler is connected between said ring frame and said support bracket.

16. A loudspeaker system, comprising:

an enclosure having a number of panels interconnected to form an interior, said enclosure including a first panel formed with a panel opening and a second panel located opposite said first panel;

an acoustic coupler including a wall having an inner section and an outer section, said outer wall being connected to said first panel, said inner section forming a coupler opening which defines a coupler opening area;

a passive radiator having a central opening and a double suspension comprising an outer roll and an inner roll, said passive radiator being connected to at least one of said inner and outer sections of said acoustic coupler at said panel opening in said first panel;

a driver having mounting structure which defines a mounting area, said driver being connected to at least one of said inner and outer sections of said acoustic coupler within said interior of said enclosure such that said mounting structure is located within a plane which is spaced from said passive radiator, said coupler opening area being less than or equal to said driver mounting area.

17. The loudspeaker system of claim 16 in which said inner and outer sections of said wall of said acoustic coupler are joined together, said mounting structure of said driver being connected to said acoustic coupler at the juncture of said inner and outer sections.

18. The loudspeaker system of claim 16 in which said inner section of said acoustic coupler includes a generally annular portion which forms said coupler opening having a cross sectional area, said cross sectional area of said coupler opening defining said coupler opening area.

19. The loudspeaker system of claim 16 in which said mounting area is up to about three times greater than said coupler opening area of said acoustic coupler.

20. The loudspeaker of claim 16 in which said driver includes a frame, said mounting structure of said driver comprising at least one flange joined to said frame.

21. A loudspeaker system, comprising:

an enclosure having a number of panels interconnected to form an interior, said enclosure including a first panel formed with a panel opening and a second panel located opposite said first panel;

a passive radiator having a central opening and a double suspension comprising an outer roll and an inner roll, said passive radiator being connected to said first panel at said panel opening therein;

a support bracket having first and second ends, said first end being mounted to said second panel;

a driver having mounting structure which defines a mounting area, said mounting structure being connected to said second end of said support bracket and being located in a plane which is spaced from said passive radiator;

an acoustic coupler connected between said passive radiator and said second end of said support bracket, said acoustic coupler including a wall having a coupler opening area, said coupler opening area being less than or equal to said mounting area.

22. The loudspeaker of claim 21 in which said driver includes a diaphragm, said driver being mounted to said support bracket so that said diaphragm faces said first panel of said enclosure.

23. The loudspeaker of claim 21 in which said driver includes a diaphragm, said driver being mounted to said support bracket so that said diaphragm faces said second panel of said enclosure.

24. The loudspeaker of claim 21 further including a ring frame mounted to said first panel of said enclosure at said panel opening therein, said passive radiator being connected to said ring frame.

25. The loudspeaker of claim 24 in which said acoustic coupler is connected between said ring frame and said support bracket.

26. The loudspeaker of claim 21 in which said driver includes a frame, said mounting structure of said driver comprising at least one flange joined to said frame.

27. A loudspeaker system, comprising:

an enclosure having a number of panels interconnected to form an interior, a first panel of said enclosure being formed with a panel opening;

a passive radiator having a central opening and a double suspension comprising an outer roll and an inner roll, said passive radiator being connected to said first panel at said panel opening therein;

a driver having mounting structure which defines a mounting area, said driver being located within said interior of said enclosure such that said mounting structure is generally concentric to said passive radiator;

an acoustic coupler connected between said passive radiator and said driver, said acoustic coupler including a wall having a coupler opening which defines a coupler opening area, said coupler opening area being less than or equal to said mounting area.

28. The loudspeaker of claim 27 in which said enclosure includes opposed side panels, opposed end panels, a back panel and said first panel is a front panel, said mounting structure of said driver defining a mounting diameter, said passive radiator having a central axis and said driver having a central axis.

29. The loudspeaker of claim 28 in which said generally concentric orientation of said mounting structure of said driver relative to said passive radiator comprises offsetting said driver from said passive radiator in a direction between said opposed side panels or in a direction between said opposed end panels in an amount within one mounting diameter of said driver.

30. The loudspeaker of claim 28 in which said generally concentric orientation of said mounting structure of said driver relative to said passive radiator comprises positioning said driver with respect to said passive radiator such that said central axis of said driver is angled relative to said central axis of said passive radiator.

* * * * *